US005402738A

United States Patent [19]

Carr et al.

[11] Patent Number: 5,402,738

[45] Date of Patent: Apr. 4, 1995

[54] COLLAPSIBLE COUNTER ASSEMBLY

[75] Inventors: Arthur G. Carr, Washington, D.C.; Christopher A. Durgin, Springfield, Va.

[73] Assignee: Nomadic Structures, Inc., Springfield, Va.

[21] Appl. No.: 198,774

[22] Filed: Feb. 18, 1994

[51] Int. Cl.[6] ..... A47B 3/06

[52] U.S. Cl. ..... 108/157; 312/140.2; 108/165

[58] Field of Search ..... 108/180, 157, 162, 165, 108/153; 312/140.1, 140.2, 140.3, 258, 259

[56] References Cited

U.S. PATENT DOCUMENTS

| | | | |
|---|---|---|---|
| D. 330,294 | 10/1992 | Carr et al. . | |
| 1,776,071 | 9/1930 | Horwath | 108/157 |
| 2,361,875 | 10/1944 | Sachs | 108/165 |
| 2,808,305 | 10/1957 | Jackson | 312/140.2 |
| 3,620,175 | 11/1971 | Crane et al. | 108/153 |
| 4,138,951 | 2/1979 | Nelson | 108/157 X |
| 4,512,097 | 4/1985 | Zeigler . | |
| 4,569,564 | 2/1986 | Ahmann | 312/259 |
| 4,632,040 | 12/1986 | Sheffer | 108/157 |
| 4,750,402 | 6/1988 | Markey | 108/90 X |
| 4,800,663 | 1/1989 | Zeigler . | |
| 4,941,717 | 7/1990 | Beaulieu . | |
| 4,970,841 | 11/1990 | Zeigler . | |
| 5,004,595 | 9/1991 | Carr et al. . | |

FOREIGN PATENT DOCUMENTS

| | | | |
|---|---|---|---|
| 2113989 | 8/1983 | United Kingdom | 312/258 |

*Primary Examiner*—Laurie K. Cranmer
*Assistant Examiner*—Janet M. Wilkens
*Attorney, Agent, or Firm*—Burns, Doane, Swecker & Mathis

[57] ABSTRACT

A collapsible counter assembly conceals and is supported by one or more members forming a support surface. The counter assembly includes a counter top structure including a top panel and one or more ribs defining one or more inwardly directed corners, the ribs extending downwardly from a bottom side of the top panel. One or more side portions extend around and are fastenable to the ribs to form a wall surrounding one or more members forming a support surface. Vertical side edges of the one or more side portions are attached together in one or more lap seams, each lap seam having an exterior edge disposed vertically below the one or more inwardly directed corners, thereby hiding the exterior edge.

20 Claims, 11 Drawing Sheets

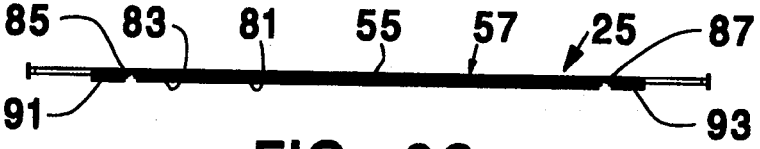
FIG. 8C
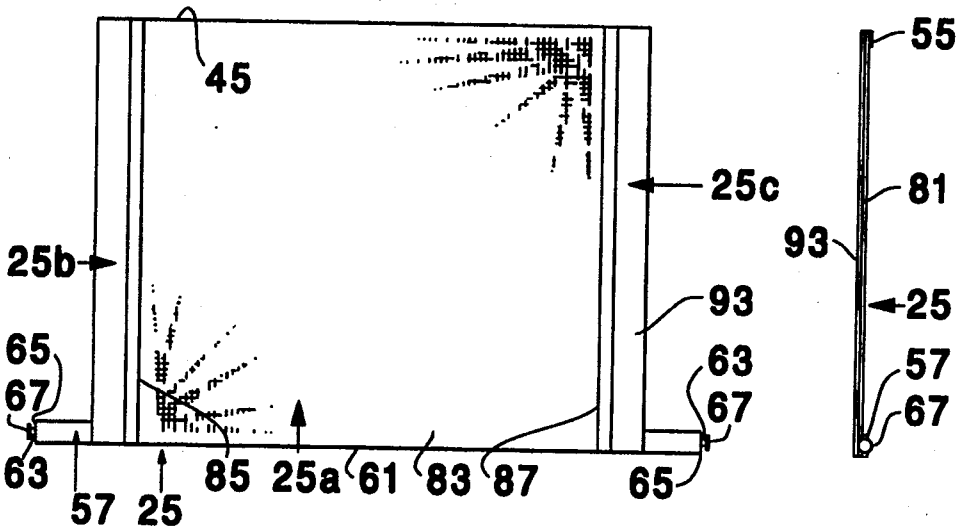
FIG. 8A
FIG. 8D
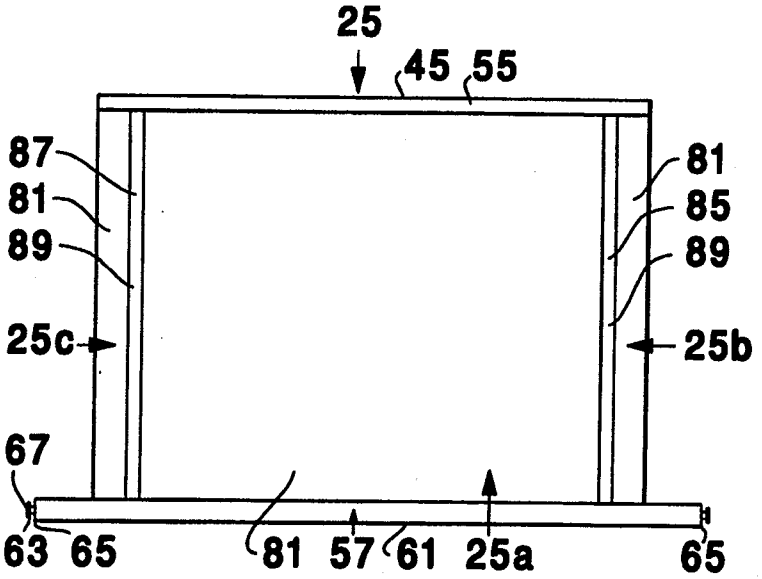
FIG. 8B

COLLAPSIBLE COUNTER ASSEMBLY

BACKGROUND

The present invention relates to collapsible counter assemblies.

In situations such as meetings and conventions, it is well known to erect temporary display walls and folding tables for the display of company advertising, etc. Many functions during which such display walls and tables are used are relatively short-lived, and the locations in which such structures are used are often intended for many purposes, such as sporting events, conventions, concerts, etc. Accordingly, collapsible, movable, reusable display walls are a popular alternative to more expensive, less versatile permanent walls.

U.S. Pat. Nos. 4,512,097, 4,800,663, and 4,970,841, for example, teach collapsible displays suitable for covering with graphic panels or fabric. The fabric, usually a carpet-like fabric, is removable from the framework and is rolled up, and the framework collapses and is able to be broken into one or several small bundles. The framework bundles and fabric rolls are relatively easy to transport and can be quickly erected when needed.

U.S. patent application Ser. No. 08/198,775 and U.S. patent application Ser. No. Des. 29/018,968, which are filed concurrently with the present application and which are hereby incorporated by reference, disclose a carrying case suited for safely shipping both the framework components and the fabric components of a collapsible display wall in a manner that minimizes the risk of damage to the fabric components by the framework components. However, after the display wall is erected, it would ordinarily be necessary to have drayage remove the carrying cases, which is inconvenient and often adds to expense.

As noted above, tables on which display elements are arranged are often used in conjunction with display walls. In the past, folding tables and the like were typically used for such purposes. Often, a fabric or other cosmetic covering is provided to wrap the edges of the table and conceal the unsightly table legs. Known fabric coverings include those comprising three or four panels that are fastened to the table top and extend from the table top to the floor to conceal the table legs. The edges of the panels at the corners of the table are either joined together in an unsightly, conspicuous corner seam or are not joined and leave an unsightly gap. Where such tables and cosmetic coverings are shipped to an event, any carrying cases used for shipping are ordinarily removed to storage.

It is, accordingly, desirable to avoid the need to remove the carrying cases, such as the carrying cases described in the above-mentioned patent applications, in which the components of a collapsible display are shipped. It is further desirable to avoid the need to remove other types of inappropriate cases or boxes from display or other areas. It is still further desirable to provide a collapsible, easily shipped table or counter assembly that is attractive and easy to erect, and that avoids the problems associated with removal of carrying cases.

Summary

In accordance with one aspect of the present invention, a collapsible counter assembly conceals and is supported by one or more members forming a support surface. The collapsible counter assembly includes a counter top structure including a top panel and a substantially I-shaped dodecagonal rib defining four inwardly directed corners and eight outwardly directed corners. The I-shaped rib extends downwardly from a bottom side of the top panel. The counter top structure has a bottom recess in which the support surface is receivable to support the counter top structure. A left side portion is adapted to extend around five sides of the I-shaped rib to form a left C-shaped wall. A right side portion is adapted to extend around five sides of the I-shaped rib to form a right C-shaped wall. A front side portion is adapted to extend along at least one side of the I-shaped rib to form a front wall. A rear side portion is adapted to extend along at least one side of the I-shaped rib to form a rear wall. Means are provided for fastening at least portions of horizontal top edges of each of the left side portion, the right side portion, the front side portion, and the rear side portion to the I-shaped rib. Means are provided for attaching vertical side edges of the left side portion, the right side portion, the front side portion, and the rear side portion together in lap seams having exterior edges vertically aligned below the four inwardly directed corners of the I-shaped rib.

In accordance with another aspect of the 11E are present invention, a collapsible counter assembly conceals and is supported by one or more members forming a support surface. The collapsible counter assembly includes a counter top structure including a top panel and a rib defining one or more inwardly directed corners. The rib extends downwardly from a bottom side of the top panel. The counter top structure has a bottom recess in which the support surface is receivable to support the counter top structure. One or more side portions are adapted to extend around the rib to form a wall surrounding one or more members forming a support surface. Means are provided for fastening at least portions of horizontal top edges of the one or more side portions to the rib. Means are provided for attaching vertical side edges of the one or more side portions together in one or more lap seams, each lap seam having an exterior edge disposed vertically below the one or more inwardly directed corners.

BRIEF DESCRIPTION OF THE DRAWINGS

The features and advantages of the present invention are well understood by reading the following detailed description in conjunction with the drawings in which like numerals indicate similar elements and in which:

FIGS. 8A, 8B, 8C, and 8D front, rear, top, and side views of a first wall panel of a collapsible counter assembly according to an embodiment of the present invention showing the first wall panel in an unfolded condition;

DETAILED DESCRIPTION

Figure 1:
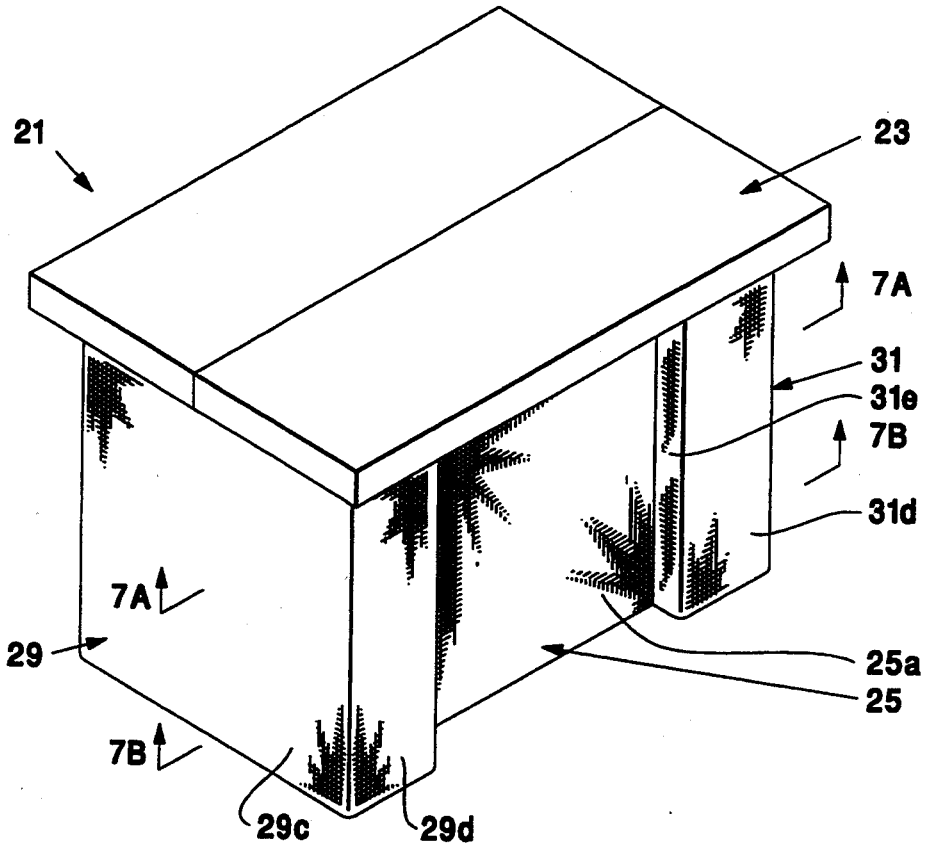
FIG. 1 is a perspective view of a collapsible counter assembly according to an embodiment of the present invention.
Figure 3:
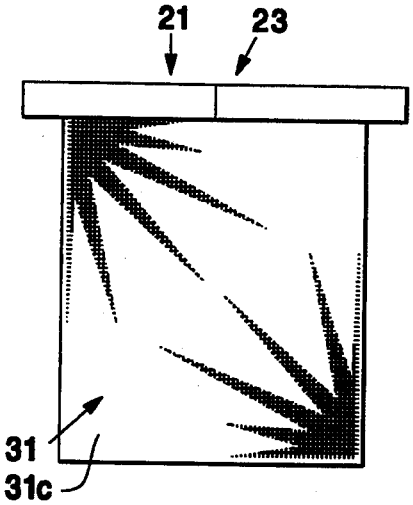
FIG. 3 is a right side view of a collapsible counter assembly according to an embodiment of the present invention.
Figure 2:
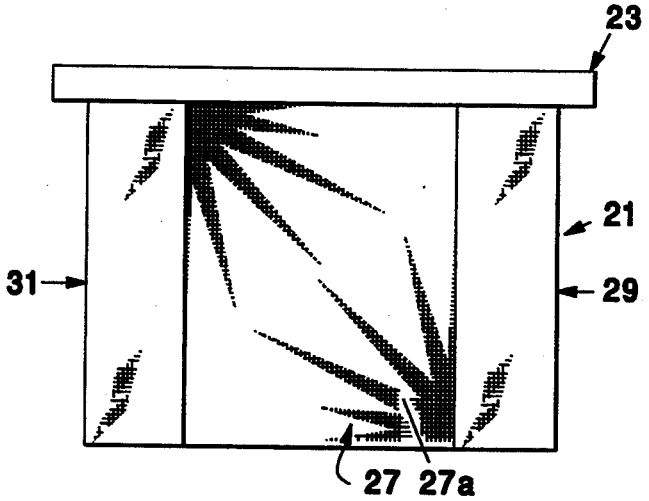
FIG. 2 is a rear side view of a collapsible counter assembly according to an embodiment of the present invention.

A fully erected collapsible counter assembly 21 according to a preferred embodiment of the present invention is seen with reference to FIGS. 1-3. The counter assembly 21 includes a counter top 23, substantially identical front and rear side portions 25 and 27, and substantially identical left and right side portions 29 and 31. If desired, graphics panels are mounted on the counter assembly 21 on any of the front, rear, left, and right side portions 25, 27, 29, and 31.

The left and right side portions 29 and 31 each include five sections 29*a–e* and 31*a–e* which are all visible in the erected counter assembly 21 and are folded relative to one another to form substantially C-shaped ends of the counter assembly 21. The front and rear side portions 25 and 27 each include one section 25*a* and 27*a* that is visible in the erected counter assembly 21. As discussed further below, the front and rear side portions 25 and 27 further include left and right sections 25*b–c* and 27*b–c*, attached at left and right edges to the sections 25*a* and 27*a*, that are hidden in the erected counter assembly 21.

The left sections 25*b* and 27*b* are overlapped by the end sections 29*a* and 29*e* of the left side portion 29, respectively. The right sections 25*c* and 29*c* are overlapped by the end sections 31*a* and 31*e* of the right side portion 31, respectively. The overlapping sections form four substantially "invisible" lap seams.

Figure 4C:
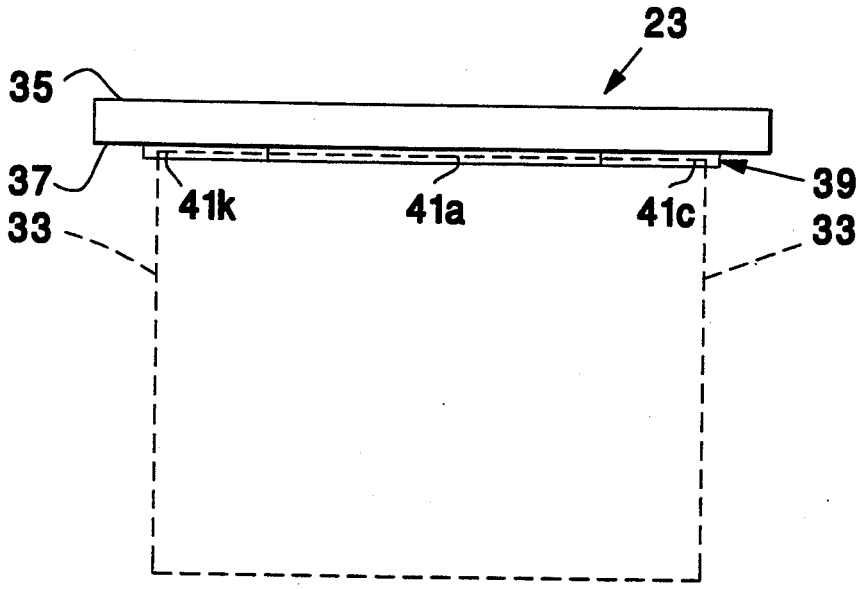
FIGS. 4A, 4B, and 4C are front side perspective, bottom side, and front side views, respectively, of a counter of a collapsible counter assembly according to an embodiment of the present invention.
Figure 4A:
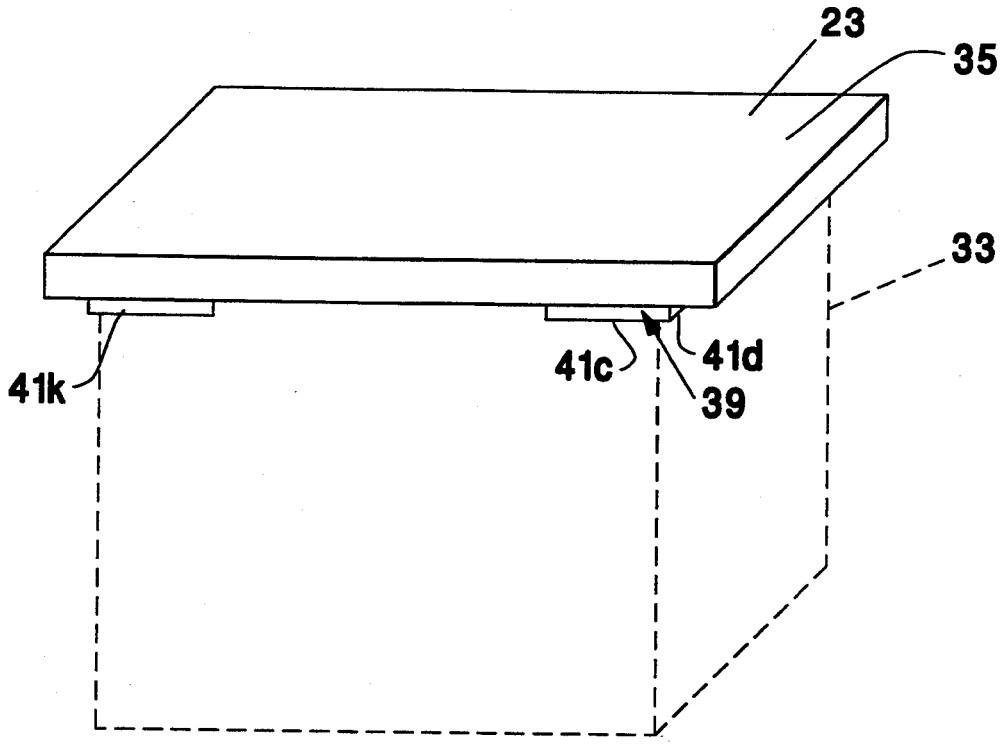
Figure 4B:
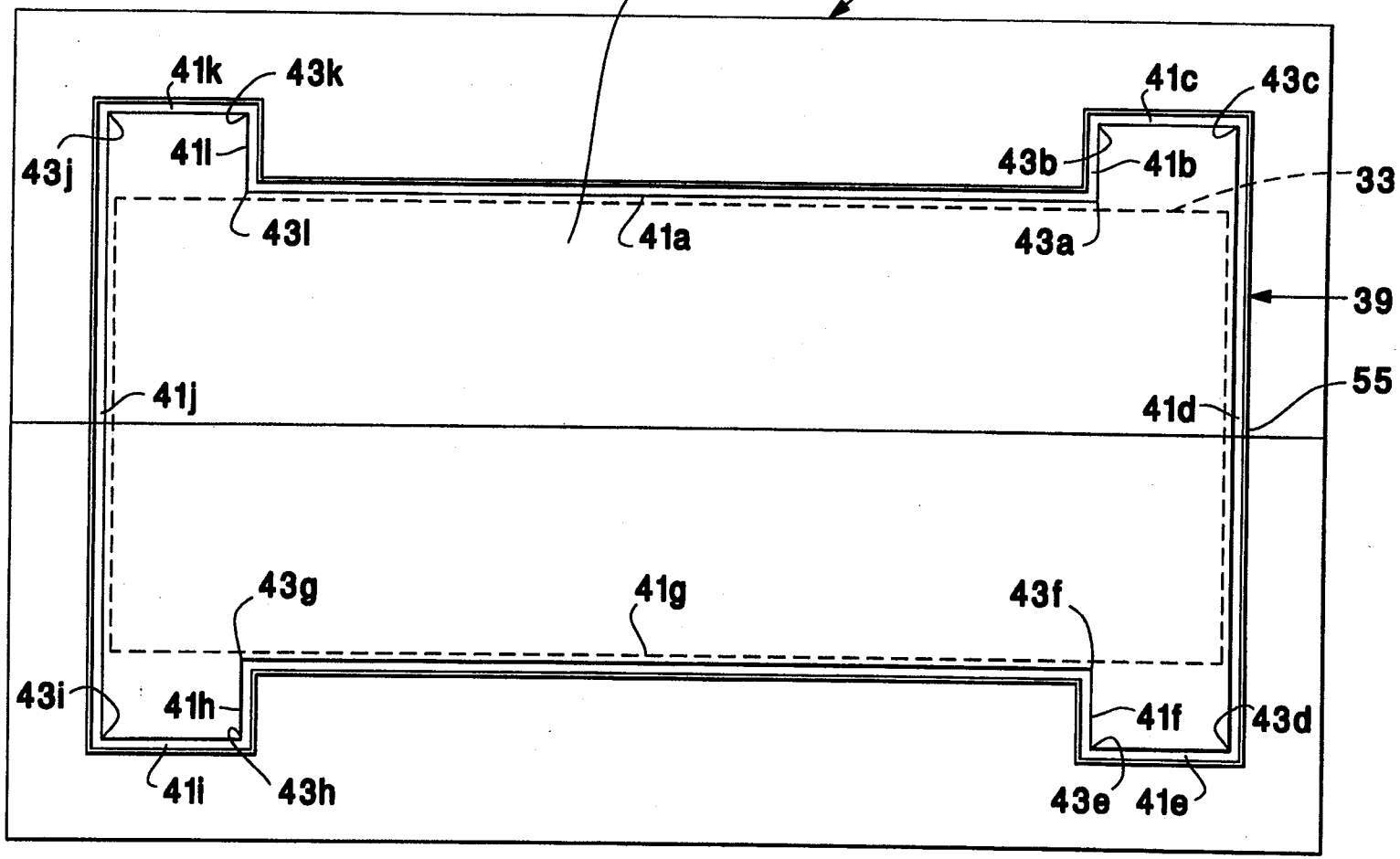

As seen with reference to FIGS. 4A–4C, the counter top 23 is preferably supported by one or more members forming a pedestal 33. The pedestal 33 provides a support surface at a particular vertical height, the support surface having sufficient horizontal width and depth dimensions to balance the counter top. The pedestal 33 is preferably in the form of one or more, preferably two, carrying cases of the type disclosed in U.S. patent application Ser. No. 08/198,775 and U.S. patent application Ser. No. Des. 29/018,968, both entitled "Carrying Case Having Detachable Step Stool" both of which are filed concurrently with the present application and are incorporated by reference. The carrying cases disclosed in those applications define a substantially rectangular support surface over which the counter top 23 is placed. The carrying cases are ordinarily provided with wheels, and the wheels of one of the two cases are preferably oriented at 90° to the wheels of the other case to prevent the pedestal 33 from moving. The pedestal 33 may, however, be any structure adapted to support the counter top 23, such as a table or a box.

The counter top 23 has a substantially flat top surface 35. As seen in FIG. 4B, the counter top 23 also has a bottom surface 37 on which a substantially I-shaped, twelve-sided, i.e., dodecagonal, rib 39 is provided. The twelve sides 41*a–l* of the rib 39 meet at or define twelve corners 43*a–l*. The four corners 43*a*, 43*f*, 43*g*, 431 point inwardly and the eight corners 43*b–e* and 43*h–k* point outwardly. The top of the pedestal 33 is preferably as wide as the distance between the sides 41*d* and 41*j* and as deep as the distance between the sides 41*a* and 41*g* so that, as seen in FIGS. 4B–4C, the top of the pedestal fits inside a volume defined by the bottom surface 37 of the counter top 23 and the rib 39 with little or no play.

Preferably, an interior face of the rib 39 is provided with a lip and an exterior face of the pedestal 33 is provided with a lip receiving recess so that, when the counter top 23 is formed of two pieces, the lip on the rib of the counter top is slid into the recess on the pedestal. One or more draw latches are preferably provided on the rib 39 of two piece counter tops 23 to secure the two pieces together. Thus, when the lip on the counter top 23 is received in the recess of the pedestal 33, and the draw latches on the two pieces of the counter top are latched to secure the counter top together, the counter top is substantially locked to the pedestal.

Figure 5:
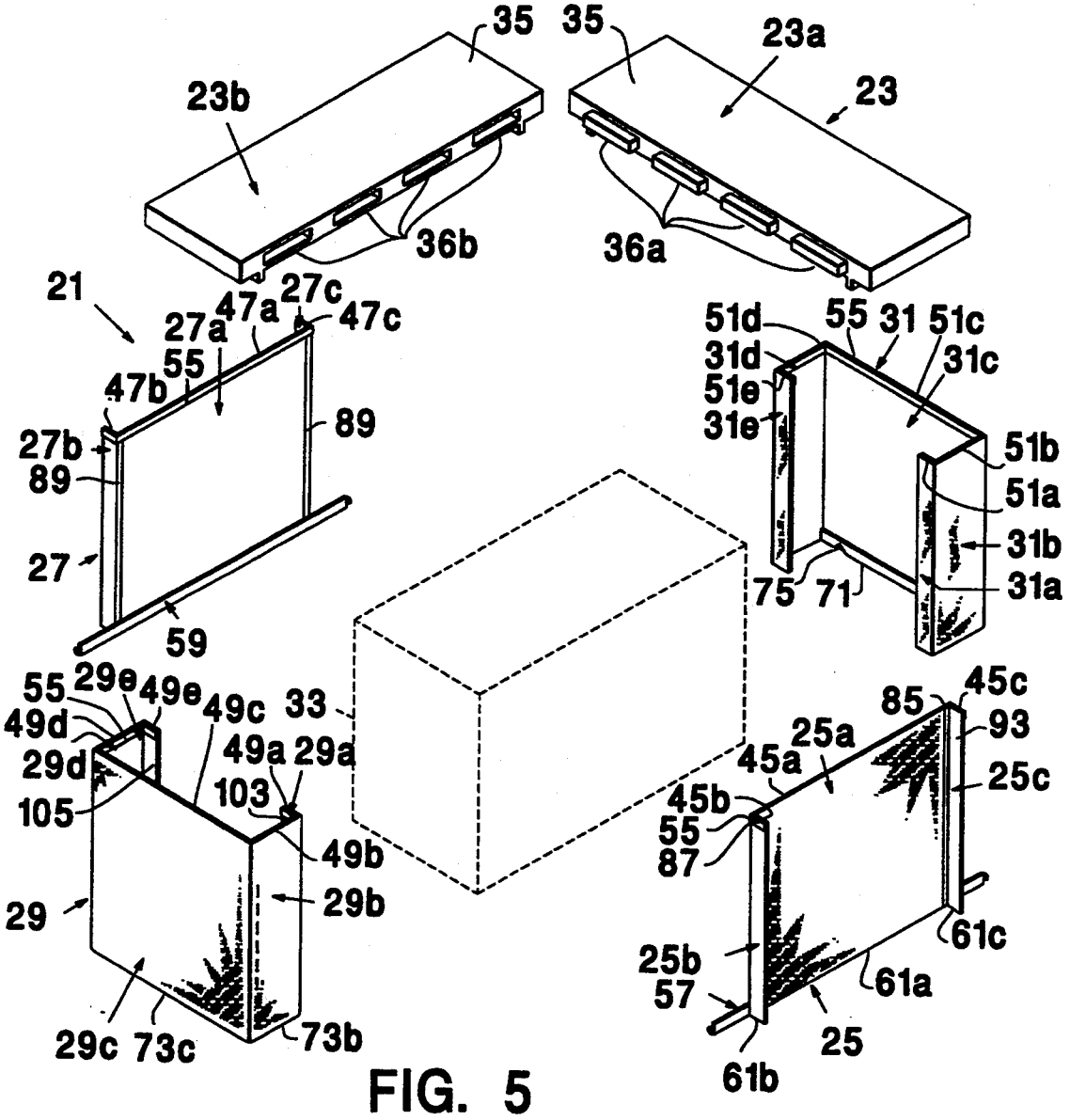
FIG. 5 is an exploded perspective view of the components of a collapsible counter assembly according to an embodiment of the present invention showing certain of the components in a folded condition.
Figure 6:
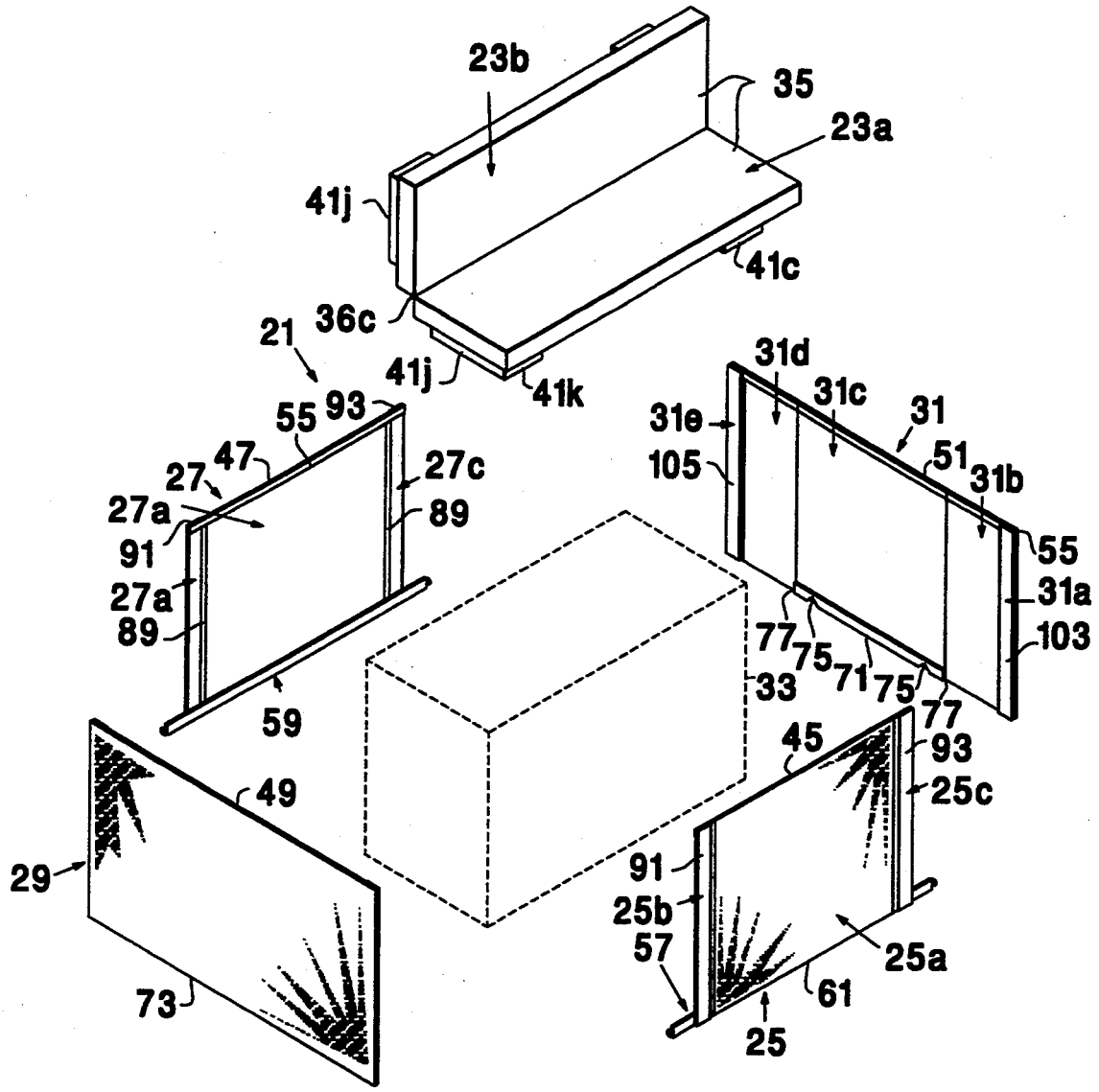
FIG. 6 is an exploded perspective view of the components of a collapsible counter assembly according to an embodiment of the present invention showing the components in an unfolded condition.

As seen in FIGS. 5 and 6, the counter top 23 may be formed by two or more attachable or attached parts 23*a* and 23*b*. As seen in FIG. 5, a front part 23*a* and a rear part 23*b* are held in position relative to one another by male and female engaging portions such as tongues 36*a* and grooves 36*b*. As seen in FIG. 6, front and rear parts 23*a* and 23*b* of the counter top 23 are attached to one another by one or more hinges 36*c*.

As seen in the exploded views of FIGS. 5 and 6, the top, front, rear, left, and right sides of the pedestal 33 are concealed by the counter top 23, the front side portion 25, the rear side portion 27, the left side portion 29, and the right side portion 31, respectively. The left side portion 29 and the right side portion 31 are preferably provided with hinges that define the sections 29*a–e* and 31*a–e* of the left and right side portions. Hinges are preferably also provided on the front and rear side portions 25 and 27 and define the sections 25*a–c* and 27*a–c*. The hinges defining the sections of the side portions permit folding of the side portions into the forms shown in FIG. 5 and unfolding of the side portions into the forms shown in FIG. 6. Preferred characteristics of the hinges are described further below.

Figure 7A:
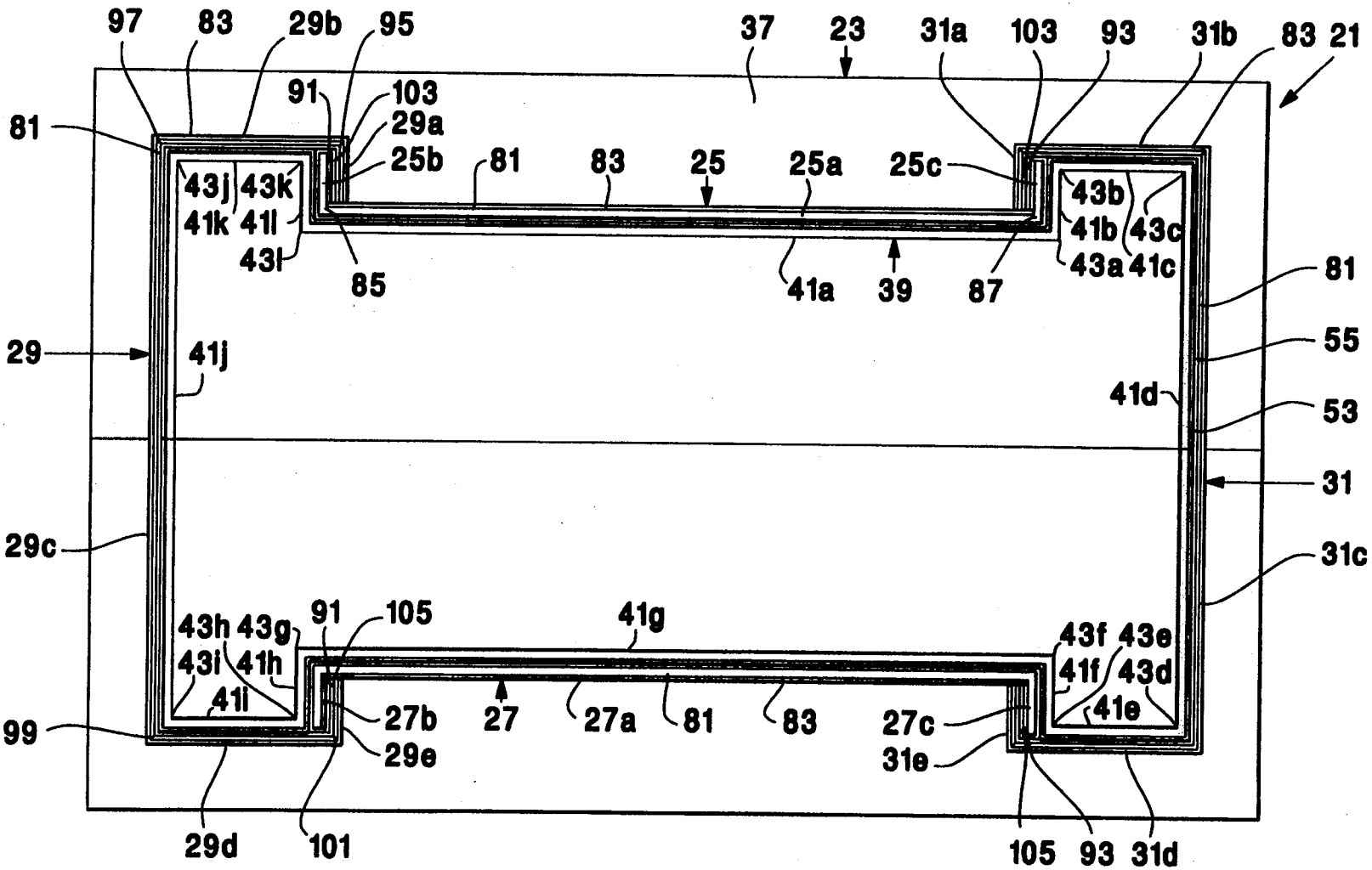
FIGS. 7A and 7B are bottom views of the collapsible counter assembly of FIG. 1, taken at section 7A—7A and 7B—7B of FIG. 1, respectively, with the supporting pedestal removed for clarity.

The front side portion 25, the rear side portion 27, the left side portion 29, and the right side portion 31 are attached at their top edges 45, 47, 49, and 51, respectively, to the rib 39. More particularly, as seen in FIG. 7A, the sections 25*b*, 25*a*, and 25*c* of the front side portion 25 are attached at their top edges 45*b*, 45*a*, and 45*c* (seen, for example, in FIGS. 5 and 6) to the sides 41*a*, 41*l*, and 41*b* of the rib 39, respectively. Likewise, the sections 27*b*, 27*a*, and 27*c* of the rear side portion 27 are attached at their top edges 47*b*, 47*a*, and 47*c* to the sides 41g, 41h, and 41f of the rib 39, respectively. The sections 29b–d of the left side portion 29 are attached at their top edges 49b–d to sides 41k–i of the rib 39, respectively. The sections 31b–d of the right side portion 31 are attached at their top edges 51b–d to sides 41c–e of the rib 39, respectively.

In the erected counter assembly 21, the edges of the left and right sections 25b–c and 27b–c of the front and rear side portions 25 and 27 are disposed substantially adjacent to the corners 43k, 43b, 43h, and 43e, respectively. The edges of the end sections 29a and 29e of the left side portion 29 overlap the left sections 25b and 27b of the front and rear side portions 25 and 27, respectively, and are disposed substantially adjacent to the corners 43l and 43g, respectively. The edges of the end sections 31a and 31e of the right side portion 31 overlap the right sections 25b and 27b, respectively, and are disposed substantially adjacent to the corners 43a and 43f, respectively.

The top edges 45a–c, 47a–c, 49b–d, and 51b–d of the side portions 25, 27, 29, and 31, respectively, are preferably attached to the sides 41a–of the rib 39 by a hook 53 and pile 55 fastener system such as "VELCRO", available from Velcro USA, Consumer Products Div., Manchester, N.H.; however, other attachment systems, such as snap fasteners, may be used. Preferably, the pile fastener 55 is attached to the top edges 45a–c, 47a–c, 49b–d, and 51b–d on interior faces of the side portions 25, 27, 29, and 31, respectively, and the hook fastener 53 is attached around the outside periphery of the sides 41a–l of the rib 39. In this manner, the rib 39 is concealed by the side portions 25, 27, 29, and 31 in the fully assembled counter assembly 21.

Figure 7B:
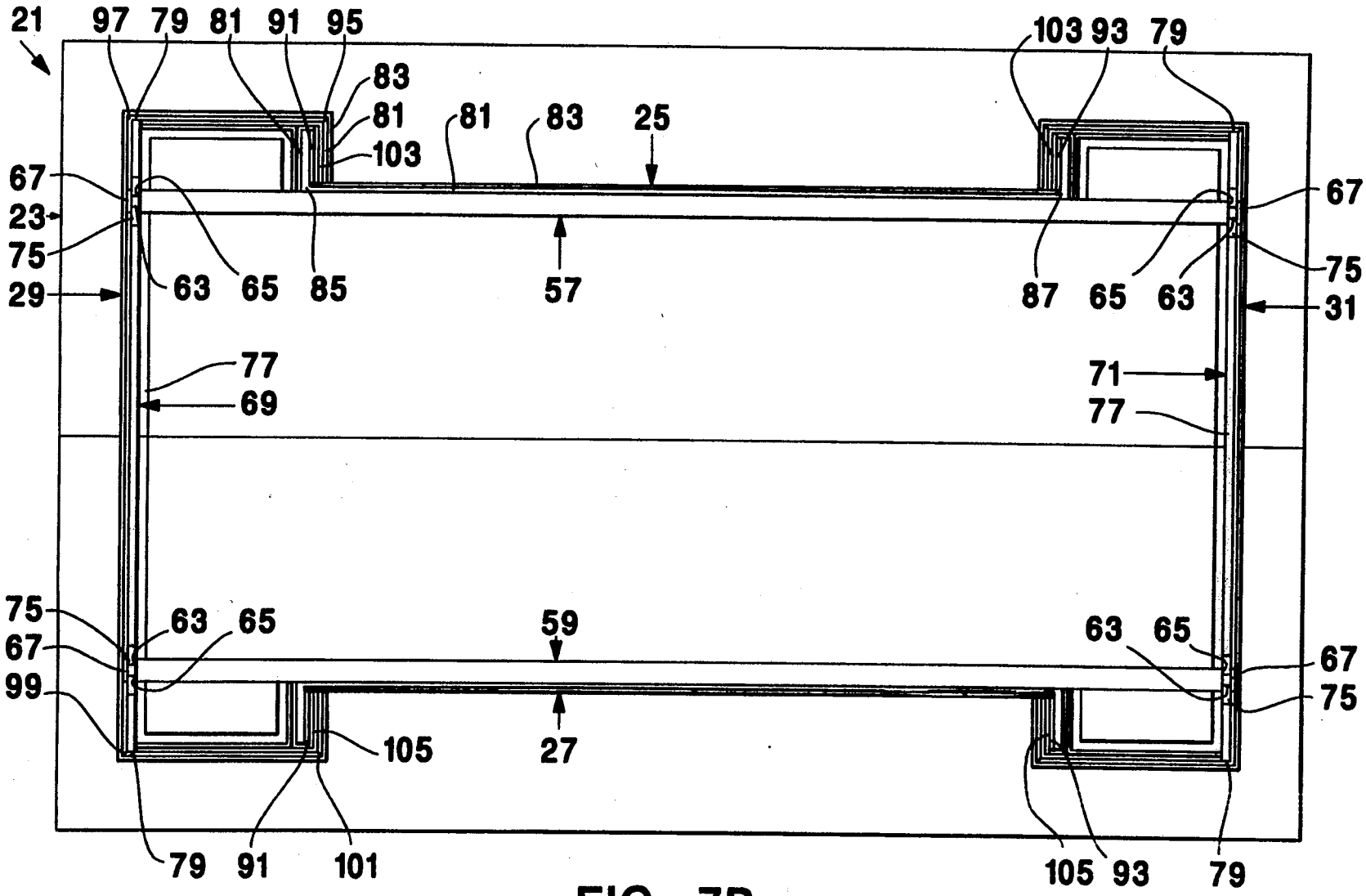
Figures 9A, 9B, 9C, 9D:
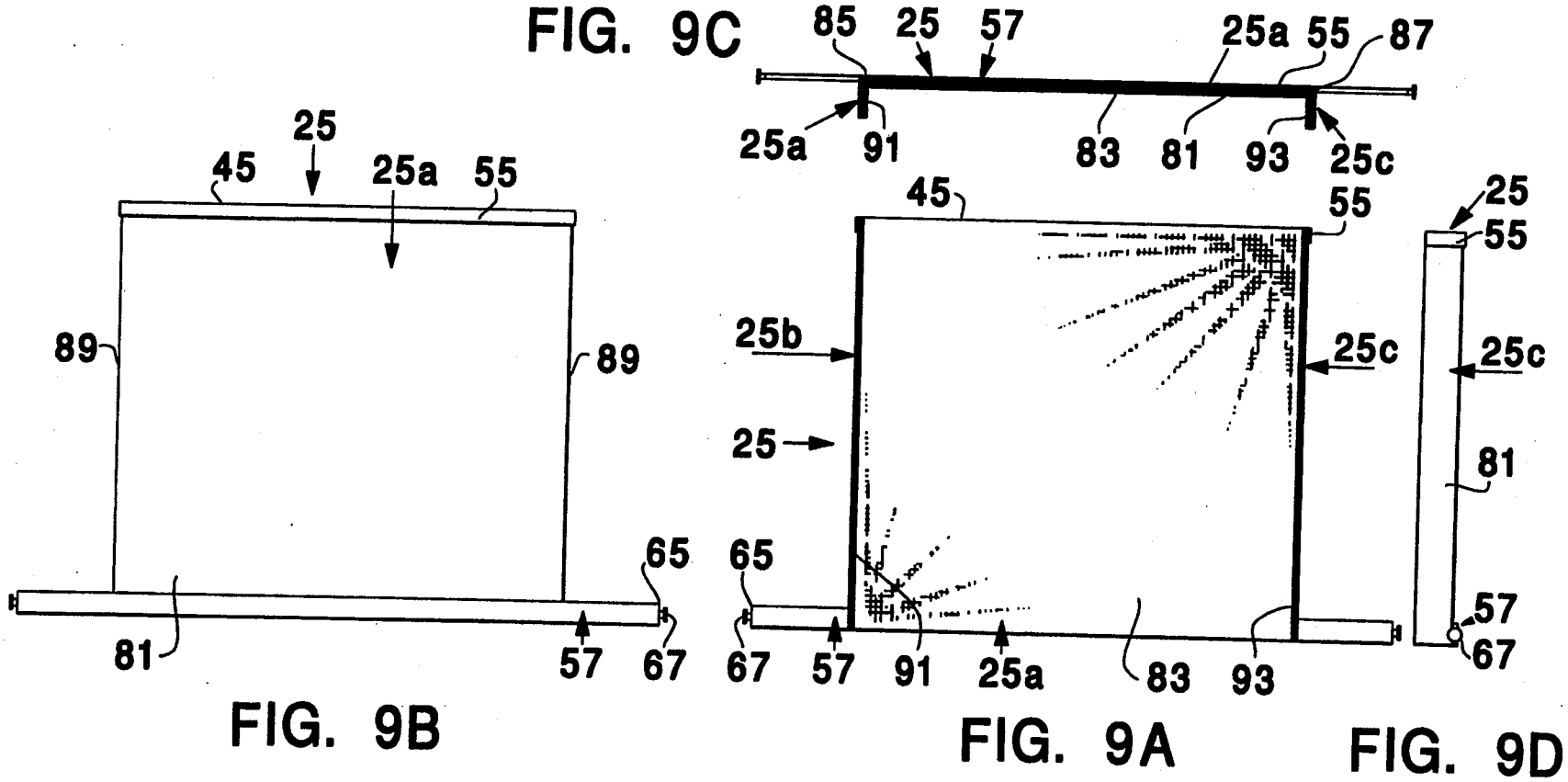
FIGS. 9A, 9B, 9C, and 9D are front, rear, top, and side views of a first wall panel of a collapsible counter assembly according to an embodiment of the present invention showing the first wall panel in a folded condition.
Figure 10A:
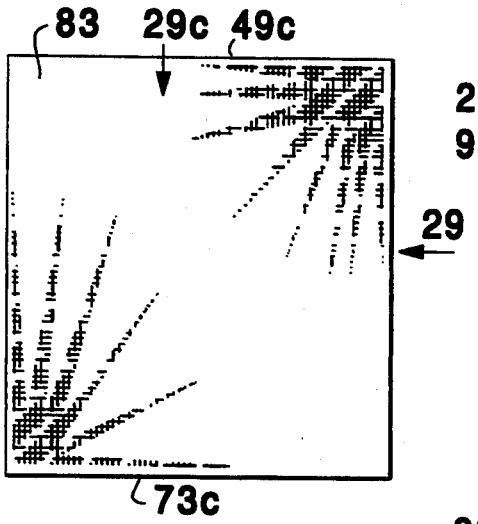
FIGS. 10A, 10B, 10C, 10D, and 10E are front, rear, side, top, and bottom views of a second wall panel of a collapsible counter assembly according to an embodiment of the present invention showing the second wall panel in a folded condition.
Figure 10D:
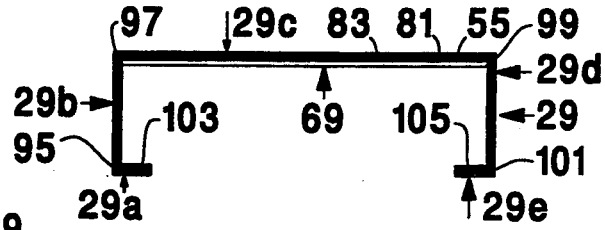
Figure 10B:
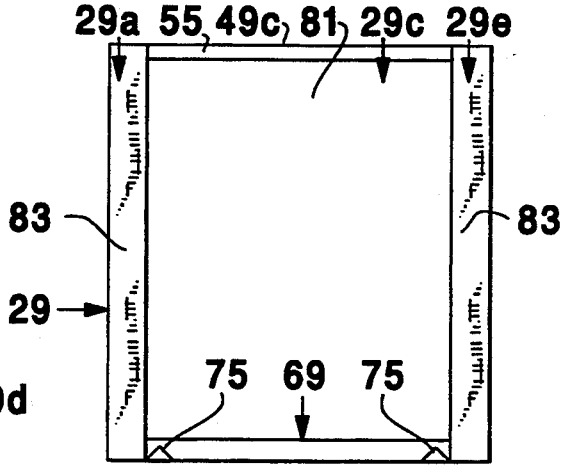
Figure 10C:
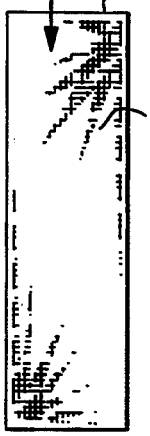
Figure 10E:
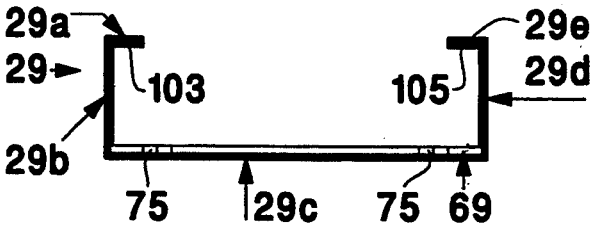
Figure 11E:
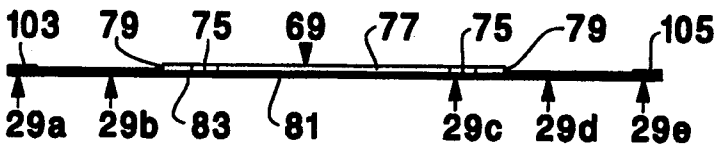
FIGS. 11A, 11B, 11C, 11D, and front, rear, side, top, and bottom views of a second wall panel of a collapsible counter assembly according to an embodiment of the present invention showing the second wall panel in an unfolded condition.
Figure 11A:
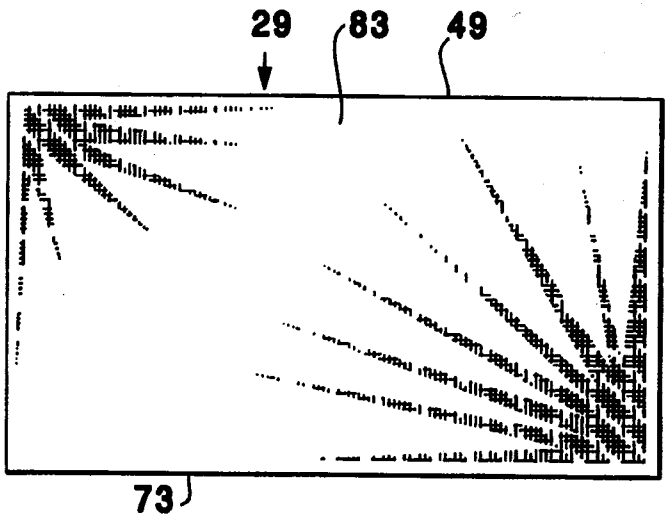
Figure 11D:
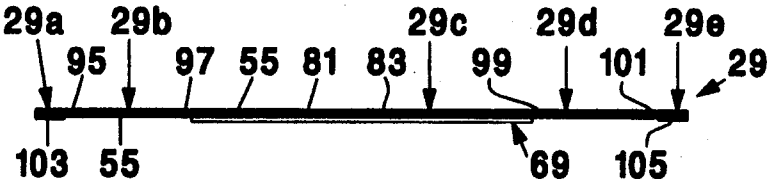
Figure 11C:
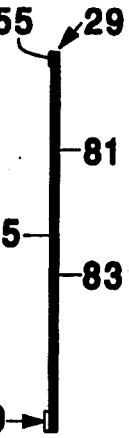
Figure 11B:
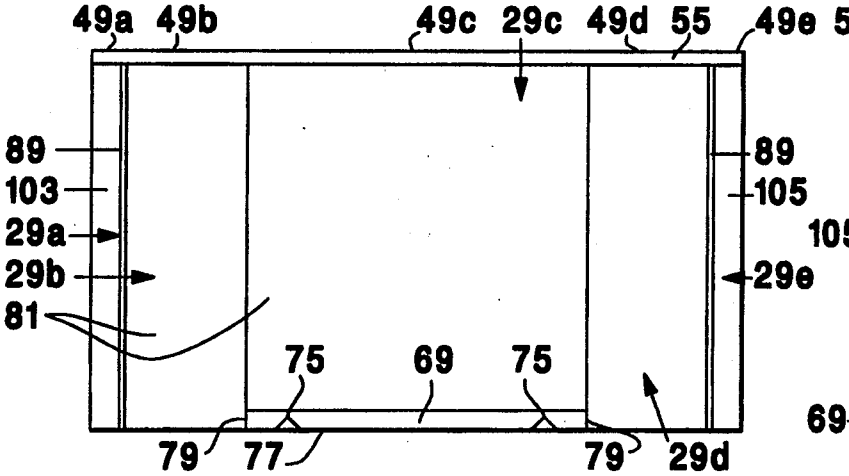

As seen in FIG. 7B, front and rear side stiffener bars 57 and 59 are attached to the front and rear side portions 25 and 27, respectively, to maintain the shape of bottom edges of the counter assembly 21. Referring to the front side portion 25, for purposes of example, as seen in FIGS. 8A–8B and 8D, and 9A–9B and 9D, the front stiffener bar 57 is preferably an elongated member attached to an interior face of the front side portion at the bottom end 61a of the section 25a. The rear stiffener bar 59 is similarly an elongated member attached to an interior face of the rear side portion 27 at the bottom end of the section 27a in the same manner. The stiffener bars 57 and 59 are attached to the front and rear side portions 25 and 27, respectively, by any suitable means, such as by an adhesive.

The ends 63 of the front and rear stiffener bars 57 and 59 preferably extend past left and right edges of the sections 25a and 27a, respectively, a distance slightly less than the lengths of the sides 41c, 41e, 41i, and 41k. Pins 65 extend from the ends 63 of the front and rear stiffener bars and buttons or hooks 67 are provided on the ends of the pins.

As seen in FIG. 7B, left and right side stiffener bars 69 and 71 are attached to the left and right side portions 29 and 31, respectively, to maintain the shape of the bottom edges of the counter assembly 21 by engaging with the buttons on the front and rear stiffener bars 57 and 59. Referring to the left side portion 29, for purposes of example, as seen in FIGS. 10B, 10E, 11B–C and 11E, the left stiffener bar 69 is preferably attached to an interior face of the left side portion at the bottom end 73c of the section 29c. Notches 75 are provided in bottom edges 77 of the left and right side stiffener bars 69 and 71, preferably at points removed from ends 79 of the left and right side stiffener bars a distance slightly greater than the length of the sides 41b, 41f, 41h, and 41l As seen in FIG. 7B, when the front, rear, left, and right side portions 25, 27, 29, and 31 are attached to the sides 41a–l of the rib 39, the notches 75 in the bottoms edges 77 of the left and right side stiffener bars 69 and 71 engage with the buttons 67 on the pins 63 at the ends 65 of the front and rear side stiffener bars 57 and 59 by being fit over the pins and buttons. The left and right side stiffener bars 69 and 71 are preferably U-shaped in cross-section and the buttons 67 are preferably received between flanges of the left and right side stiffener bars. Alternatively, as shown in FIG. 7B, the buttons are received in a space between the left and right side stiffener bars 69 and 71 and the bottom ends of the sections 29c and 31c of the left and right side portions 29 and 31. When the buttons 67 on the front and rear stiffener bars 57 and 59 are held in position by the left and right stiffener bars 69 and 71, outward bowing of the sections 29c and 31c which might occur as a result of folding the left and right side portions 29 and 31 into a C-shape is prevented, thereby maintaining a desirable, substantially square overall appearance of the counter assembly. It will be understood, of course, that, instead of using the above-described notch 75 and button 67 arrangement, alternative arrangements for preventing outward bowing are available, such as by providing magnets, snaps, keys, etc. on stiffener bars or similar elements.

Exterior, interior, top, and right side views of the front side portion 25 in an unfolded condition are shown in FIGS. 8A–8D, respectively. Exterior, interior, top, and right side views of the front side portion 25 in a folded condition are shown in FIGS. 9A–9D, respectively. The rear side portion 27 is substantially identical to the front side portion 25 and the following description of the front side portion is equally applicable to the rear side portion, except where otherwise indicated.

The sections 25a–c of the front side portion 25 all preferably include a relatively rigid wall material 81, preferably formed from a plastic sheet, preferably a PVC or polycarbonate sheet. A fabric layer 83, preferably a carpet-like material, is attached to the exterior side of the wall material 81 of the section 25a, such as by an adhesive. The fabric layer 83 is generally less; rigid than the wall material 81 and the wall material facilitates keeping the fabric layer from becoming deformed during use. The wall material 81 is preferably sufficiently flexible to permit the front side portion 25 to be loosely rolled up around the front side stiffener bar 57.

The sections 25a–c of the front panel 25 are defined by left and right hinges 85 and 87. The hinges 85 and 87 are preferably in the form of vertical interruptions, preferably V-shaped grooves, in the exterior surface of the wall material 81 and extend from the top edge 45 to the bottom edge 61 of the front side portion. Tape 89 preferably reinforces the hinges 85 and 87. The hinges 85 and 87 may, however, be in the form of vertical cuts through the wall material 81, and the tape may form the hinges. The hinges 85 and 87 may, of course, be in other forms, such as in the form of one or more plastic or metallic hinges secured to the sections 25a–c. In the erected counter assembly 21, the hinges 85 and 87 are disposed substantially adjacent to the inwardly directed corners 43l and 43a, respectively. Similar hinges on the rear side portion 27 are disposed substantially adjacent to the inwardly directed corners 43g and 43f, respectively.

Left and right magnetic strips 91 and 93 are attached to the exterior side of wall material 81 of the left and right sections 25*b–c*, respectively. The magnetic strips 91 and 93 preferably extend from the top edges 45*b–c* of the left and right sections 25*b–c* to the bottom edges 61*b–c*. Gaps are preferably provided between edges of the left and right magnetic strips 91 and 93 and the left and right hinges 85 and 87, respectively, to facilitate folding of the sections 25*b–c* relative to the section 25*a*. As noted above, fastening elements, preferably one of a hook 53 and pile 55 fastener system, are attached along the top edge 45 of the interior surface of the front side portion 25. The front side stiffener bar 57 is attached along the bottom edge 61*a* of the interior surface of the section 25*a* of the front side portion 25.

Exterior, interior, left, top, and bottom side views of the left side portion 29 in a folded condition are shown in FIGS. 10A–10E. Exterior, interior, left, top, and bottom side views of the left side portion 29 in an unfolded condition are shown in FIGS. 11A–11E. The left side portion 29 is substantially identical to the right side portion 31 and the following description of the left side portion is equally applicable to the right side portion, except where otherwise indicated.

All of the sections 29*a–e* of the left side portion 29 include wall material 81 such as is used in the front side portion 25. A continuous layer of fabric material 83 is attached, such as by an adhesive, to the wall material 81 and extends from the top edges 49*a–e* of the sections to the bottom edges 73*a–e*. If desired, the fabric material 83 on the left side portion 29 is of a different color than the fabric material on the front side portion 25 to provide a more interesting appearance to the counter assembly 21.

The sections 29*a–e* are defined by outer front, inner front, inner rear, and outer rear hinges 95, 97, 99, and 101, respectively. The hinges 95, 97, 99, and 101 are also preferably in the form of vertical interruptions or grooves, preferably V-shaped grooves, provided in the wall material 81 and extending from the top edge 49 to the bottom edge 73 of the left side portion 29. Tape 89 preferably reinforces the hinges or, where, instead of vertical grooves, vertical cuts extend through the wall material 81, forms the hinges. Further, the continuous fabric layer 83 may, if desired, reinforce or form the hinges, instead of or in addition to the tape. In the erected counter assembly 21, the hinges 95, 97, 99, and 101 are disposed substantially adjacent to the outwardly directed corners 43*k*, 43*j*, 43*i*, and 43*h*, respectively. Similar hinges on the right side portion 31 are disposed substantially adjacent to the outwardly directed corners 43*b*, 43*c*, 43*d*, and 43*e*, respectively.

As noted above, fastening elements, preferably one of a hook 53 and pile 55 fastener system, are attached along the top edge 49 of the interior surface of the left side portion 29. Front and rear magnetic strips 103 and 105 are attached along the end sections 29*a* and 29*e* of the left side portion 29. The magnetic strips 103 and 105 preferably extend from the bottom edges 73*a* and 73*e* of the end sections 29*a* and 29*e* to below the one of the hook 55 and pile 53 fastener. Gaps are preferably provided between edges of the front and rear magnetic strips 103 and 105 and the outer front and outer rear hinges 95 and 101, respectively, to facilitate folding of the end sections 29*a* and 29*e* relative to the sections 29*b* and 29*d*, respectively.

When the front, rear, left, and right side portions 25, 27, 29, and 31 are folded as seen in FIGS. 5, 9A–9D, and 10A–10D, and are fastened to the sides 41*a–l* of the rib 39, as seen in FIG. 7A, the left magnetic strips 91 on the front and rear side portions face and attach to the front and rear magnetic strips 103 and 105 on the left side portion 29. Similarly, the right magnetic strips 93 on the front and rear side portions 25 and 27 face and attach to the front and rear magnetic strips 103 on the right side portion 31.

The magnetic strips 91, 93, 103, 105 are preferably all formed of two, aligned magnetic strips. The two aligned strips have outward faces of opposite polarity and mate with corresponding pairs of strips also having outward faces of opposite polarity. Such strips are well-known and accurately align with one another. It is understood that suitable alternatives to the above-mentioned magnetic strips include well-known fastener systems such as hook and pile fastener systems and snap fastener systems.

As seen in FIGS. 7A and 7B, the outward edges of the end sections 29*a*, 29*e*, 31*a*, and 31*e* of the left and right side portions 29 and 31 abut the fabric layer 83 of the front and rear side portions 25 and 27. The left sections 25*b* and 27*b* of the front and rear side portions 25 and 27 are hidden from view behind the sections 29*a–b* and 29*d–e*, respectively. Similarly, the right sections 25*c* and 27*c* of the front and rear side portions 25 and 27 are hidden from view behind the sections 31*a–b* and 31*d–e*, respectively. Thus, the lap seams formed by the sections 25*b* and 29*a*, 25*c* and 31*a*, 27*b* and 29*a*, and 27*c* and 29*e* have exterior edges that are aligned substantially directly vertically below the inwardly directed corners 43*l*, 43*a*, 43*g*, and 43*f*, respectively.

By locating the outward edges of the end sections 29*a*, 29*e*, 31*a*, and 31*e* adjacent the interior corners 43*a*, 43*f*, 43*g*, and 43*l*, the fabric layers 83 on the front, rear, left, and right side portions provide the appearance, in the erected counter assembly 21, of being substantially seamless. The counter assembly 21 of the present invention having four "invisible seams" therefore avoids the unsightly visible seams or open gaps common to known counter arrangements, particularly counter arrangements constructed of elements that are adapted to be rolled up. Further, by providing an "I" shape to the vertical walls of the counter assembly 21, a "toe kick" is provided and makes working at the counter assembly more comfortable.

It is understood that the counter assembly 21 according to the present invention may be in forms other than the illustrated, substantially box-shaped counter assembly. For example, the "invisible seams" of the counter assembly may be provided wherever it is possible to provide an inwardly directed corner. Shapes of counters that can include inwardly directed corners include "U" "C" and heart-shaped counters The counter assembly 21 has been described with reference to an embodiment in which front and rear side portions 25 and 27 each include left and right sections 25*b–c* and 27*b–c* connected to left and right edges of center side portions 25*a* and 27*b*, respectively. However, it is understood that the counter assembly 21 may be formed with front and rear side portions 25 and 27 having no foldable left and right sections. In such an embodiment, additional sections (not shown) are preferably provided on the left and right side portions, outside of the end sections 29*a*, 29*e*, 31*a*, and 31*e*. Magnetic strips are preferably provided on exterior surfaces of the additional sections and on interior surfaces of left and right edges of the front and rear side portions. The lap seams formed by such side portions is vertically aligned below the inwardly directed corners of the ribbed 39, however, the exterior edges of the lap seams are formed by left and right edges of the front and rear panels.

The components of the counter assembly 21 are preferably capable of being shipped in one or more carrying cases forming the pedestal 33, such as the carrying case disclosed in U.S. Pat. application Ser. No. 08/198,775 and U.S. patent application Ser. No. Des. 24/018,968, both of which are incorporated by reference. The components of the counter assembly 21 are preferably adapted to be contained in a small space, such as by loosely rolling up the front, rear, left, and right side portions 25, 27, 29, and 31, and folding or taking apart front and rear parts. 23*a* and 23*b* of the counter top 23.

While this invention has been illustrated and described in accordance with a preferred embodiment, it is recognized that variations and changes may be made therein without departing from the invention as set forth in the claims.

What is claimed is:

1. A collapsible counter assembly, the collapsible counter assembly concealing and being supported by one or more members, the one or more members forming a support surface, the collapsible counter assembly comprising:

a counter top structure including a top panel and a substantially I-shaped dodecagonal rib defining four inwardly directed corners and eight outwardly directed corners, the I-shaped rib extending downwardly from a bottom side of the top panel, the counter top structure having a bottom recess in which the support surface is receivable to support the counter top structure;

a left side portion adapted to extend around five sides of the I-shaped rib to form a left C-shaped wall;

a right side portion adapted to extend around five sides of the I-shaped rib to form a right C-shaped wall;

a front side portion adapted to extend along at least one side of the I-shaped rib to form a front wall;

a rear side portion adapted to extend along at least one side of the I-shaped rib to form a rear wall;

means for fastening at least portions of horizontal top edges of each of the left side portion, the right side portion, the front side portion, and the rear side portion to the I-shaped rib; and first means for attaching vertical side edges of the left side portion, the right side portion, the front side portion, and the rear side portion together in lap seams having exterior edges vertically aligned below the four inwardly directed corners of the I-shaped rib.

2. The collapsible counter assembly as set forth in claim 1, wherein the left, right, front, and rear side portions extend from the I-shaped rib to ground level.

3. The collapsible counter assembly as set forth in claim 1, wherein the counter top structure includes a front and a rear half and second means for attaching the front and rear half together.

4. The collapsible counter assembly as set forth in claim 3, wherein the second attaching means includes one or more protrusions formed on one of the front and the rear half and corresponding protrusion receiving grooves formed on one of the rear and the front half, respectively.

5. The collapsible counter assembly as set forth in claim 3, wherein the second attaching means includes one or more hinges.

6. The collapsible counter assembly as set forth in claim 3, further comprising means for locking the front and rear halves together.

7. The collapsible counter assembly as set forth in claim 1, wherein the fastening means includes a hook fastener on one of either the I-shaped rib or at least portions of the top edges of each of the left side portion, the right side portion, the front side portion, and the rear side portion, and a mating pile fastener on the other one of either the I-shaped rib or at least portions of the top edges of each of the left side portion, the right side portion, the front side portion, and the rear side portion.

8. The collapsible counter assembly as set forth in claim 1, wherein the first attaching means includes magnetic strips provided on the side edges of the left side portion, the right side portion, the front side portion, and the rear side portion.

9. The collapsible counter assembly as set forth in claim 1, further comprising means for restraining bottom edges of the left and right side portions to prevent outward bowing of the bottom edges.

10. The collapsible counter assembly as set forth in claim 9, wherein the restraining means includes at least one elongated member having engagement portions on opposite ends thereof, the elongated member being attached to a bottom edge of at least one of the front and rear side portions, and corresponding engagement portions disposed at the bottom edges of the left and right side portions, the engagement portions being adapted to engage with the corresponding engagement portions.

11. The collapsible counter assembly as set forth in claim 10, wherein the corresponding engagement portions are formed in bars attached at the bottom edges of the left and right side portions.

12. The collapsible counter assembly as set forth in claim 1, wherein the left side portion, the right side portion, the front side portion, and the rear side portion all include an outer fabric layer.

13. The collapsible counter assembly as set forth in claim 12, wherein the left side portion, the right side portion, the front side portion, and the rear side portion all include an inner layer attached to the outer fabric layer, the inner layer having greater rigidity than the fabric layer.

14. The collapsible counter assembly as set forth in claim 13, wherein the inner layer is a plastic material.

15. The collapsible counter assembly as set forth in claim 13, wherein the left side portion and the right side portion each include five sections defined by vertical interruptions in the inner layers of the left and right side portions, the vertical interruptions facilitating folding of the left and right side portions such that each of the left and right side portions define five sides of the collapsible counter assembly.

16. The collapsible counter assembly as set forth in claim 15, wherein the vertical interruptions are in the form of grooves extending partially through the inner layers.

17. The collapsible counter assembly as set forth in claim 15, wherein the vertical interruptions are in the form of cuts extending through the inner layers.

18. The collapsible counter assembly as set forth in claim 15, wherein the front side portion and the rear side portion each include three sections defined by vertical interruptions in the inner layers of the front and rear side portions, the vertical interruptions facilitating folding of the front and rear side portions such that each of the front and rear side portions includes a central side that is exposed in the erected collapsible counter assembly and a left and a right side that are hidden behind sides of the left and right panels.

19. A collapsible counter assembly, the collapsible counter assembly concealing and being supported by one or more members, the one or more members forming a support surface, the collapsible counter assembly comprising:

a counter top structure including a top panel and one or more ribs defining one or more inwardly directed corners, the ribs extending downwardly from a bottom side of the top panel, the counter top structure having a bottom recess in which the support surface is receivable to support the counter top structure;

one or more side portions adapted to extend around the ribs to form a wall surrounding the support surface;

means for fastening at least portions of horizontal top edges of the one or more side portions to the ribs; and means for attaching vertical side edges of the one or more side portions together in one or more lap seams, each lap seam having an exterior edge disposed vertically below the one or more inwardly directed corners.

20. The collapsible counter assembly as set forth in claim 19, wherein the ribs are an endless rib.

* * * * *